US012773597B2

(12) United States Patent
Engle et al.

(10) Patent No.: US 12,773,597 B2
(45) Date of Patent: Oct. 27, 2026

(54) GOLF BALL HAVING SPHERICAL QUADRILATERAL SEGMENTED DIMPLE PATTERN

(71) Applicant: Acushnet Company, Fairhaven, MA (US)

(72) Inventors: Courtney N. Engle, Fall River, MA (US); John S. Dytko, Derby, CT (US); Michael R. Madson, Easton, MA (US)

(73) Assignee: Acushnet Company, Fairhaven, MA (US)

( * ) Notice: Subject to any disclaimer, the term of this patent is extended or adjusted under 35 U.S.C. 154(b) by 191 days.

(21) Appl. No.: 18/630,958

(22) Filed: Apr. 9, 2024

(65) Prior Publication Data

US 2025/0312656 A1 Oct. 9, 2025

(51) Int. Cl.
*A63B 37/00* (2006.01)
*A63B 37/14* (2006.01)

(52) U.S. Cl.
CPC .... *A63B 37/00065* (2020.08); *A63B 37/0006* (2013.01); *A63B 37/002* (2013.01)

(58) Field of Classification Search
CPC ..... A63B 37/00065; A63B 37/0006
See application file for complete search history.

(56) References Cited

U.S. PATENT DOCUMENTS 5,735,756 A * 4/1998 Stiefel ..... A63B 37/00065 473/384
6,540,625 B2 4/2003 Sajima
6,849,007 B2 2/2005 Morgan et al.
7,361,102 B2 4/2008 Ladd et al.
7,422,529 B2 9/2008 Aoyama et al.
7,503,856 B2 3/2009 Nardacci et al.
7,927,233 B2 4/2011 Sullivan
8,834,300 B2 9/2014 Sullivan et al.
8,845,456 B2 9/2014 Comeau et al.
9,205,308 B2 12/2015 Sullivan et al.
9,795,836 B2 10/2017 Comeau et al.
10,183,195 B2 1/2019 Madson et al.
10,814,179 B1 * 10/2020 Madson ..... A63B 37/002
2003/0153402 A1 8/2003 Simonds
2013/0072325 A1 3/2013 Madson et al.
2013/0288827 A1 10/2013 Hwang
2020/0338395 A1 * 10/2020 Madson ..... A63B 37/0006
(Continued)

OTHER PUBLICATIONS

Office Action dated Mar. 19, 2026 for U.S. Appl. No. 18/630,955.
(Continued)

*Primary Examiner* — John E Simms, Jr.
(74) *Attorney, Agent, or Firm* — Thomas P. Gushue

(57) ABSTRACT

Various aspects of a dimple pattern methodology, and dimple pattern configurations are disclosed herein. A spherical quadrilateral segment division can be used to maintain a high level of symmetry in the dimple pattern while also maintaining a specific dimple layout in polar regions of the golf ball. In one aspect, the specific configurations disclosed herein can provide geometric symmetry while being adaptable to relatively complex processes for forming golf ball covers. Furthermore, the configurations disclosed herein provide a dimple pattern with a high level of symmetry having a particular subset of preferred polar dimples.

14 Claims, 5 Drawing Sheets

(56) References Cited

U.S. PATENT DOCUMENTS

| | | | | |
|---|---|---|---|---|
| 2021/0093925 | A1* | 4/2021 | Madson | A63B 37/0012 |
| 2021/0138305 | A1 | 5/2021 | Engle et al. | |
| 2022/0105392 | A1 | 4/2022 | Engle et al. | |
| 2022/0161097 | A1* | 5/2022 | Madson | A63B 37/0021 |
| 2022/0266095 | A1* | 8/2022 | Madson | A63B 37/0021 |
| 2022/0280839 | A1 | 9/2022 | Madson et al. | |
| 2022/0331667 | A1 | 10/2022 | Engle et al. | |
| 2023/0050722 | A1* | 2/2023 | Madson | A63B 37/002 |
| 2023/0121950 | A1 | 4/2023 | Engle et al. | |
| 2023/0338780 | A1 | 10/2023 | Engle et al. | |
| 2024/0050810 | A1 | 2/2024 | Engle et al. | |
| 2025/0121254 | A1* | 4/2025 | Dytko | A63B 37/002 |
| 2025/0312653 | A1* | 10/2025 | Engle | A63B 37/0021 |
| 2025/0312655 | A1* | 10/2025 | Engle | A63B 37/0006 |

OTHER PUBLICATIONS

Office Action dated Dec. 2, 2025 for U.S. Appl. No. 18/630,955.
Office Action dated Jan. 9, 2026 for U.S. Appl. No. 18/630,940.
Office Action dated Apr. 24, 2026 for U.S. Appl. No. 18/630,940.
Office Action dated Mar. 12, 2026 for U.S. Appl. No. 18/630,946.

* cited by examiner

GOLF BALL HAVING SPHERICAL QUADRILATERAL SEGMENTED DIMPLE PATTERN

FIELD OF THE INVENTION

This disclosure generally relates to a golf ball, and is more particularly related to dimple patterning for a golf ball.

BACKGROUND OF THE INVENTION

It is well known that modifying the dimple pattern on golf balls can result in varying aerodynamic patterns. Accordingly, the significance of the dimple pattern is critical to golf ball performance.

In addition to the need to balance dimple profile design features in view of performance of the golf ball, there is an additional need to ensure that specific dimple patterns are suitable for varying formation techniques for golf ball covers. Some techniques for forming golf ball covers are more complex than others, and may require additional control to ensure stability and concentricity of a golf ball sub-assembly while forming the cover.

It would be desirable to provide a high-performance dimple pattern for a golf ball that is suitable for golf ball covers formed according to relatively complex cover formation techniques.

SUMMARY OF THE INVENTION

In some aspects, the present disclosure is directed to a methodology, framework, or general features for a dimple pattern.

In other aspects, the present disclosure is directed to a specific dimple pattern including a predetermined layout, quantity of dimples, dimple shapes, etc.

In yet other aspects, the present disclosure is directed to a methodology and pattern for arranging dimples relative to a polar axis of a golf ball. In one aspect, a preferred subset of polar dimples of a golf ball are of increased criticality for particular golf ball cover formation techniques.

In one aspect, a golf ball having an outer surface comprising a plurality of dimples disposed thereon that define a dimple pattern is provided herein. The golf ball can be segmented via an equatorial plane, and a first plane and a second plane each being orthogonal to the equatorial plane and to each other, such that a first subset of four zones define a first hemisphere of the golf ball and a second subset of four zones define a second hemisphere of the golf ball. The first and second subset of four zones can be comprised of first zones and second zones, such that the first and second hemispheres each consist of two first zones and two second zones.

The first zone can be comprised of, consist essentially of, or consist of three spherical quadrilaterals including at least one first spherical quadrilateral and at least one second spherical quadrilateral, and the second zone be comprised of, consist essentially of, or consist of three spherical quadrilaterals including at least one third spherical quadrilateral and at least one fourth spherical quadrilateral.

In one aspect, the first, second, third, and fourth spherical quadrilaterals can each have: (i) distinct dimple configurations, and (ii) dimple configurations having mirror symmetry about a respective symmetry plane.

In one aspect, the three spherical quadrilaterals of the first zone include a single first spherical quadrilateral and two second spherical quadrilaterals. In one aspect, the three spherical quadrilaterals of the second zone include a single third spherical quadrilateral and two fourth spherical quadrilaterals. One of ordinary skill in the art would understand that these configurations can vary.

In one aspect, the at least one second spherical quadrilateral and the at least one fourth spherical quadrilateral can be disposed along the equatorial plane. In one aspect, the at least one first spherical quadrilateral and the at least one third spherical quadrilateral can each be disposed adjacent to a polar axis of the golf ball.

In one aspect, the first, second, third, and fourth spherical quadrilaterals can each have an identical size relative to each other. In one aspect, the first and second zones can each have distinct dimple patterns from each other. The first zones and the second zones can each be mirror symmetrical about a respective plane extending through a polar axis of the golf ball.

In one aspect, the dimple pattern can have at most second order rotational symmetry about any axis of the golf ball. In one aspect, the dimple pattern can have at most second order rotational symmetry about an axis defined by any two planes of the golf ball selected from: the equatorial plane, the first plane, and the second plane. One of ordinary skill in the art would understand that the rotational symmetry characteristics can vary based upon the present disclosure.

The first, second, third, and fourth spherical quadrilaterals can each include two external edges that are coplanar with at least one edge of the first or second zones, and the first, second, third, and fourth spherical quadrilaterals can each include two internal edges that are noncoplanar with edges of the first and second zones. The internal edges of the first, second, third, and fourth spherical quadrilaterals can each be shorter than the external edges of the first, second, third, and fourth spherical quadrilaterals. One of ordinary skill in the art would understand the length of the edges can vary.

In one aspect, the respective symmetry planes of the first, second, third, and fourth spherical quadrilaterals can each extend through a centroid of a respective one of the first and second zones.

The first and second zones can each be rotationally asymmetric about an axis passing through a golf ball centroid and a respective geometric face of the first zone and the second zone.

The first, second, third, and fourth spherical quadrilaterals can each be irregularly shaped polygons. One of ordinary skill in the art would understand that the shape or geometry of the spherical quadrilaterals can vary.

In one aspect, the dimple pattern can include 300-400 dimples. In one aspect, the dimple pattern can include 100-700 dimples. In one aspect, the dimple pattern can include no greater than 250 dimples. In one aspect, the dimple pattern can include at least 500 dimples.

The golf ball can lack any dimple-free great circles, in one aspect.

The plurality of dimples can include dimples of at least three different dimple diameters, in one aspect.

In one aspect, exactly two of the three spherical quadrilaterals of the first zones and exactly two of the three spherical quadrilaterals of the second zones can share a common vertex at a polar axis of the golf ball.

In one aspect, a golf ball having an outer surface comprising a plurality of dimples disposed thereon that define a dimple pattern is disclosed herein. The golf ball can be segmented into a first hemisphere and a second hemisphere, each of the first and second hemispheres being defined by a plurality of zones, and each zone being segmented into a plurality of spherical quadrilaterals each having a distinct dimple configuration. The dimple pattern can have at most second order rotational symmetry about any axis of the golf ball.

The first and second hemispheres can each include a subset of preferred polar dimples having an identical dimple diameter and a respective centroid positioned longitudinally 90 degrees apart from each other and at a common latitude. The common latitude can be defined at a polar latitude angle (0) from a nearest respective pole of the first and second hemispheres, and the polar latitude angle (0) can be no greater than 30 degrees. The subset of preferred polar dimples can include four polar dimples, in one aspect.

The term subset of preferred polar dimples is used herein to refer to a specific dimple or dimples arranged according to a specific polar latitude angle and specific longitudinal location. Other polar dimples may be positioned near the polar axis and can be positioned closer to or further from the polar axis than the subset of preferred polar dimples disclosed herein.

In one aspect, the term polar dimple is used herein to collectively refer to all dimples having centroids that are no more than 30 degrees from a nearest pole.

In one aspect, the polar latitude angle (θ) for the subset of preferred polar dimples can be no greater than 25 degrees. In another aspect, the polar latitude angle (θ) can be no greater than 20 degrees. In one aspect, the polar latitude angle (θ) is no greater than 15 degrees. In another aspect, the polar latitude angle (θ) is no greater than 10 degrees.

The centroids of each of the subset of preferred polar dimples can be coincident with a spherical edge defined between adjacent zones. In one aspect, the centroids of each dimple of the subset of preferred polar dimples are not coincident with a spherical edge defined between adjacent zones.

The centroids of each of the subset of preferred polar dimples can be coincident with a mirror symmetry plane of at least one of the spherical quadrilaterals. In one aspect, the polar dimples can include a pole dimple that can have a centroid that is coincident with a polar axis of the golf ball. In one aspect, the pole dimple and the subset of preferred polar dimples all have the same diameter, while in another aspect the pole dimple and the subset of preferred polar dimples can have different diameters. In another aspect, the dimple pattern can lack any dimple having a centroid that is coincident with a polar axis of the golf ball.

The dimple diameter of each of the subset of preferred polar dimples can have a minimum dimple diameter among the plurality of dimples. One of ordinary skill in the art would understand that the dimple diameter of the subset of preferred polar dimples can be larger than a minimum dimple diameter.

In one aspect, the edge angle, chord depth, cross sectional profile, and/or the planar profile of the subset of preferred polar dimples can vary as compared to a remainder of the plurality of dimples.

At least one additional polar dimple can be disposed closer to the poles of the first and second hemispheres than any of the subset of preferred polar dimples. The at least one additional dimple can have a larger dimple diameter than the dimple diameter of each of the subset of preferred polar dimples.

In another aspect, a golf ball having an outer surface comprising a plurality of dimples disposed thereon that define a dimple pattern is provided. The golf ball can be segmented into a first hemisphere and a second hemisphere, each of the first and second hemispheres being defined by a plurality of zones of a first quantity, and each zone being segmented into a plurality of spherical quadrilaterals each having a distinct dimple configuration. The dimple pattern can have at most second order rotational symmetry about any axis of the golf ball.

The first and second hemispheres can each include a subset of preferred polar dimples of a second quantity. The subset of preferred polar dimples can each have an identical dimple diameter and a respective centroid positioned longitudinally equidistant apart from each other and at a common latitude at a polar latitude angle (θ) from a nearest respective pole of the first and second hemispheres. The first and second quantities can be identical in one aspect. In another aspect, the first and second quantities are not identical. In one aspect, the first quantity is greater than the second quantity, and in another aspect the first quantity is less than the second quantity. In one aspect, the first quantity and the second quantity are at least three. In another aspect, the first quantity and the second quantity equal four. In another aspect, the first quantity and the second quantity are at least four.

In one aspect, the polar latitude angle (θ) is no greater than 30 degrees. In one aspect, the polar latitude angle (θ) is no greater than 25 degrees. In one aspect, the polar latitude angle (θ) is no greater than 20 degrees. In one aspect, the polar latitude angle (θ) is no greater than 15 degrees. In one aspect, the polar latitude angle (θ) is no greater than 10 degrees. In one aspect, the polar latitude angle (θ) is no greater than 5 degrees. In one aspect, the polar latitude angle (θ) is at least 10 degrees. In one aspect, the polar latitude angle (θ) is at least 15 degrees.

Additional features and aspects of the present disclosure are described in further detail herein.

BRIEF DESCRIPTION OF THE DRAWINGS

Further features and advantages of the present disclosure can be ascertained from the following detailed description that is provided in connection with the drawings described below.

DETAILED DESCRIPTION OF THE INVENTION

Figure 1:
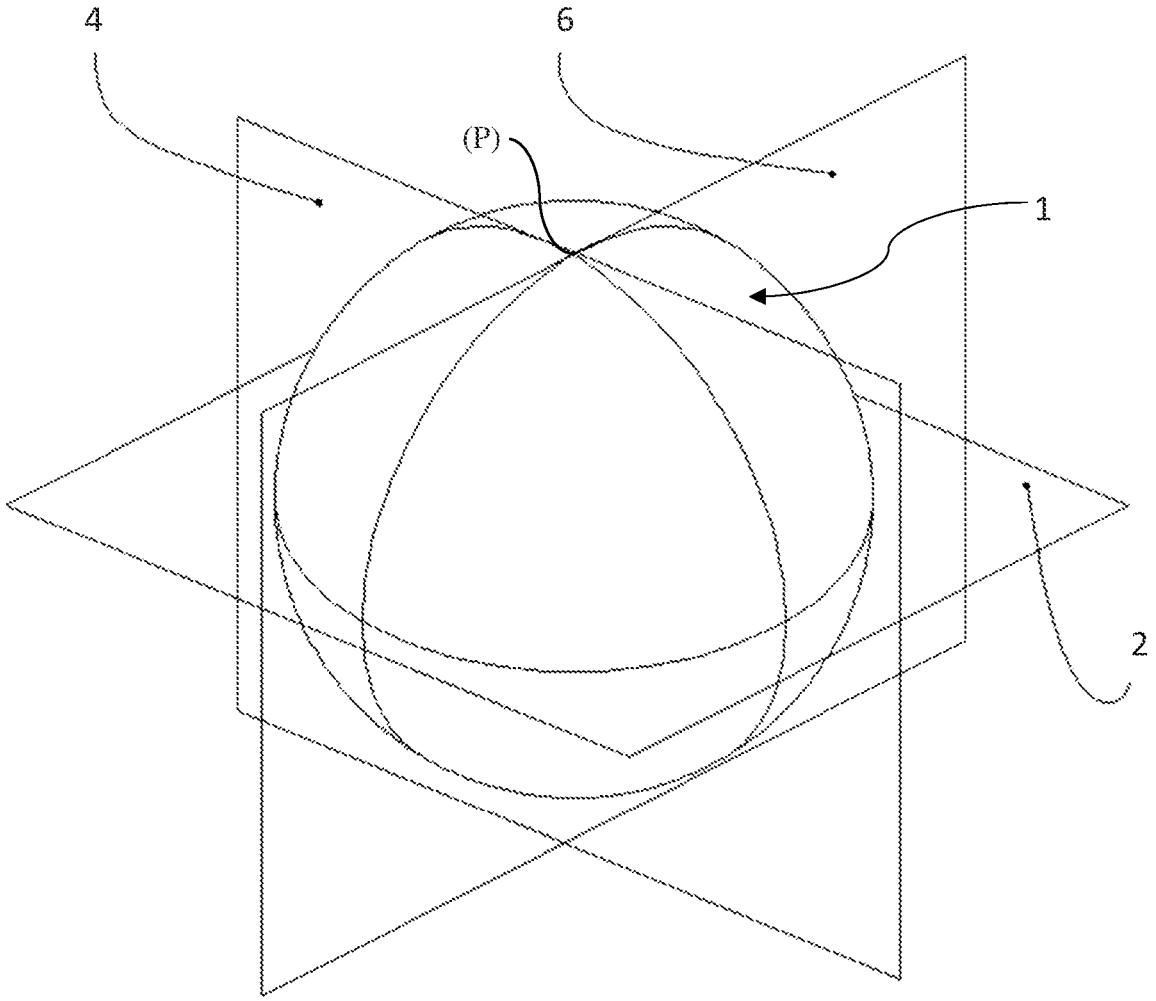
FIG. 1 is a perspective view of an exemplary golf ball divided by three reference planes.

A dimple pattern, a methodology for arranging dimples, a specific dimple configuration in regions near at least one pole of a golf ball, and at least one exemplary dimple pattern are disclosed herein. A methodology for arranging dimples in proximity to a golf ball pole is also disclosed herein. As used in one aspect, the term methodology as used in the present context can refer to a framework for arranging dimples while not requiring a level of specificity such that every dimple in the dimple pattern is specifically assigned. Accordingly, the present disclosure can be configured or adapted for use with various dimple patterns, in which the quantity of dimples, cross-sectional or planar shape, size, and other specific features can vary. One of ordinary skill in the art would appreciate based on this disclosure that a plurality of exemplary dimple patterns can be generated or based on the features and/or methodologies described herein.

In one aspect, the present disclosure provides a spherical quadrilateral division technique for segmenting the dimple pattern. In one aspect, the present disclosure is configured to provide underlying symmetry in dimple pattern design while simultaneously providing a specific polar region dimple layout. The term polar region can be used herein to refer to a region encompassing the immediately adjacent dimples to a specific pole. In certain aspects, a specific polar latitude angle (θ) from a nearest respective pole of the first and second hemispheres is provided to refer to or define a polar region. In one specific aspect, the present disclosure has substantial advantages with respect to cover formation techniques and provides a solution for symmetry correction in aerodynamic performance.

The present disclosure provides a dimple pattern that can be applied to any type of golf ball. For example, the present disclosure can be configured for use with golf balls having two-piece, three-piece, four-piece, five-piece, six-piece, or more than six-piece constructions.

The components of the golf ball, such as the core, intermediate layer or mantle or casing, and cover can be formed from known materials. The core can be a single core or dual core, or can include more than two layers. The core can be formed from rubber, in one example. The intermediate layer (i.e., casing, mantle, other medially disposed layer(s)) can encase the core and can be formed from known materials, such as ionomer. The cover can be formed from polyurethanes; polyureas; copolymers, blends and hybrids of polyurethane and polyurea, in some examples. In one aspect, the cover can be formed from any thermoplastic material.

Exemplary golf ball constructions, including further details on the various layers, materials, dimensions, and other characteristics of golf balls are disclosed in U.S. Pat. Nos. 7,361,102, 7,927,233, 8,834,300, 8,845,456, 9,205,308, 9,795,836, which are each commonly assigned to Acushnet Company and which are each incorporated in their entirety as if fully set forth herein.

In one aspect, any one or more of the dimples disclosed herein can have a circular cross-sectional profile. In one aspect, any one or more of the dimples can have a catenary cross-sectional profile. One of ordinary skill in the art would understand that various cross-sectional profiles can be used for the dimples. In one aspect, the dimples can have a planar profile that is circular or non-circular.

Figure 2:
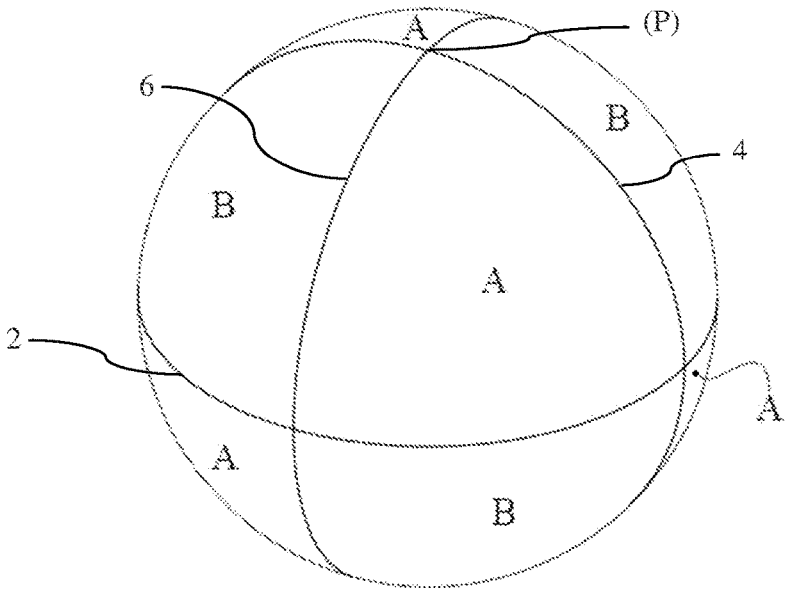
FIG. 2 is a perspective view of an exemplary golf ball having annotations for a plurality of zones (i.e., zones A and B).

In one example, a golf ball dimple pattern can be provided according to the following aspects. As shown in FIGS. 1 and 2, a sphere (i.e., a golf ball 1) can be divided by an equatorial plane (i.e., plane 2) to form two hemispheres (i.e., a first and second hemisphere), each of which are further divided by two orthogonal polar planes (i.e., planes 4 and 6) to form four zones (i.e., zones A and B) on each hemisphere that are separated by spherical segment edges. In one aspect, zone A is also referred to as a first zone herein, and zone B is also referred to as a second zone herein.

Dimples can be configured within each of the four zones of each hemisphere to have a predefined set or plurality of characteristics. For example, the dimple arrangements in the specific type of zones can be identical, such that each zone A is identical to each other, and each zone B is identical to each other. In another aspect, the dimple arrangement in zone A is different than the dimple arrangement in zone B.

The dimple arrangement within zone A and the dimple arrangement within zone B can have mirror symmetry across a plane passing through the polar axis (i.e., axis P in the Figures). An exemplary mirror symmetry plane MA is shown in FIG. 3A for zone A and an exemplary mirror symmetry plane MB is shown in FIG. 3B for zone B.

The zones (i.e., zones A and B) can be arranged on the golf ball such that the dimple pattern has a maximum of second order rotational symmetry about the polar axis of the golf ball. In one aspect, the zones can be arranged on the golf ball such that the dimple pattern has exactly a maximum of second order rotational symmetry about the polar axis of the golf ball. This aspect can be understood at least with reference to FIG. 2. The dimple pattern can have a maximum of second order rotational symmetry about any possible axis of the golf ball.

Both of the zones can be divided into at least three spherical quadrilaterals. In one aspect, both of the zones are divided into exactly three spherical quadrilaterals. In one aspect, the spherical quadrilaterals can be of equal size.

Figure 3A:
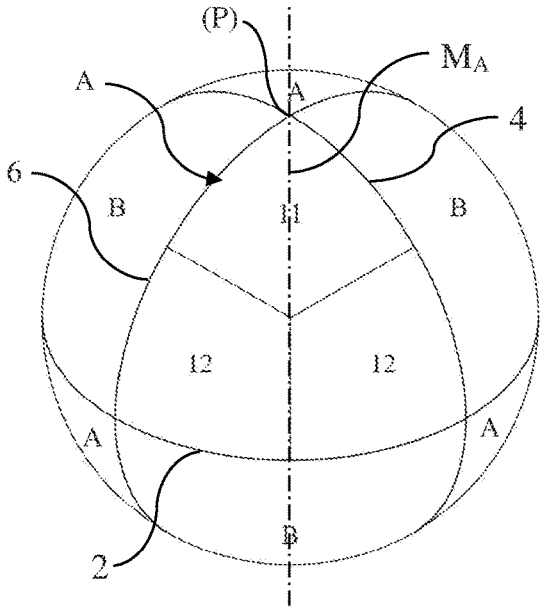
FIG. 3A is a perspective view focused on a first zone (i.e., zone A) from FIG. 2 with annotations for an exemplary layout of spherical quadrilaterals.
Figure 3B:
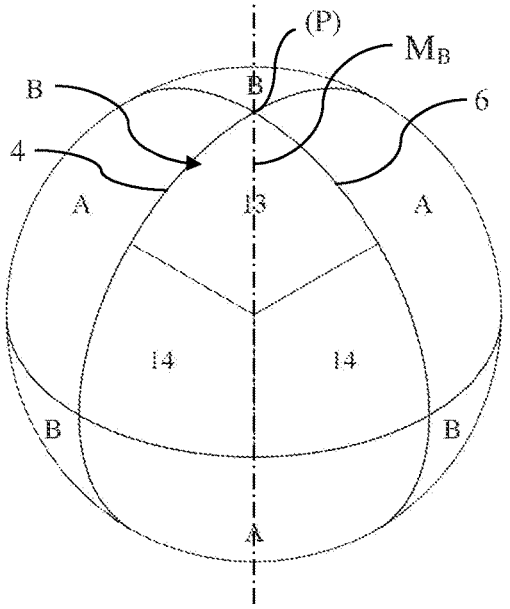
FIG. 3B is a perspective view focused on a second zone (i.e., zone B) from FIG. 2 with annotations for an exemplary layout of spherical quadrilaterals.

Zone A can be comprised of one spherical quadrilateral of a first type (i.e., first spherical quadrilateral 11 in FIG. 3A) and two identical spherical quadrilaterals of a second type (i.e., second spherical quadrilateral 12 in FIG. 3A). Zone B can be comprised of one spherical quadrilateral of a third type (i.e., third spherical quadrilateral 13 in FIG. 3B) and two identical spherical quadrilaterals of a fourth type (i.e., fourth spherical quadrilateral 14 in FIG. 3B). One of ordinary skill in the art would understand that the quantity of types of spherical quadrilaterals can vary.

The first, second, third, and fourth spherical quadrilaterals can each be divided by spherical edges, two of which can be spherical internal edges and are distinct from two spherical outer edges. In one aspect, the spherical outer edges are coplanar with the edges of the zones.

Figure 4A:
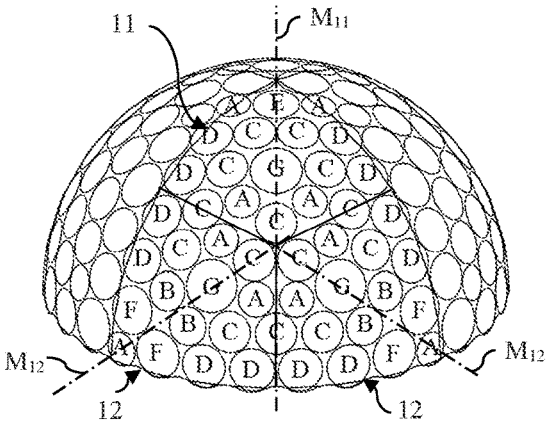
FIG. 4A is a perspective view of the first zone from FIG. 3A with annotations for an exemplary dimple pattern within respective spherical quadrilaterals.
Figure 4B:
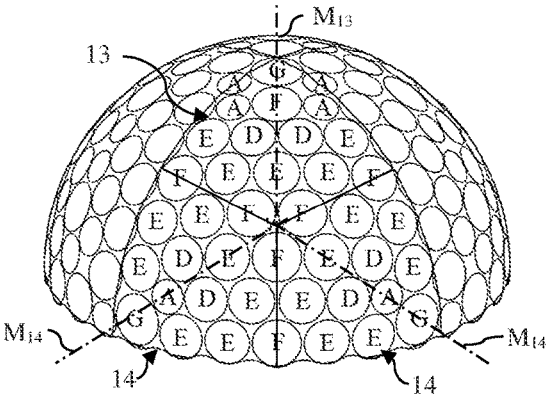
FIG. 4B is a perspective view of the second zone from FIG. 3B with annotations for an exemplary dimple pattern within respective spherical quadrilaterals.
Figure 4C:
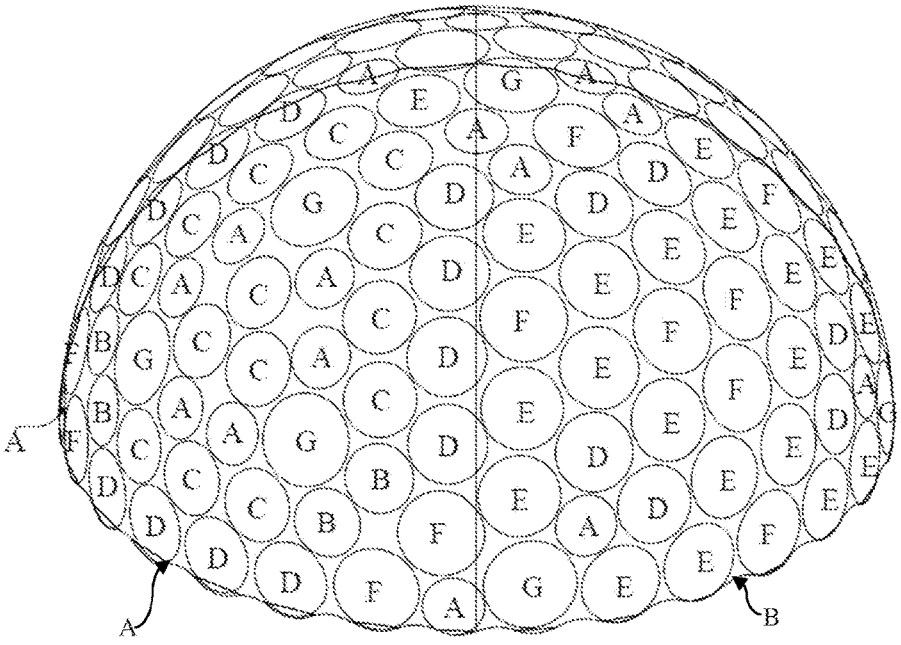
FIG. 4C is a perspective view focused on an interface between the first and second zones.

The dimples can be configured within each of the spherical quadrilaterals such that the spherical quadrilaterals are distinct from each other, which can be understood based at least on FIGS. 4A, 4B, and 4C. Each of the spherical quadrilaterals can have mirror symmetry across one plane, in one aspect. A mirror symmetry plane (M11) for the first spherical quadrilateral 11, a mirror symmetry plane (M12) for the second spherical quadrilateral 12, a mirror symmetry plane (M13) for the third spherical quadrilateral 13, and a mirror symmetry plane (M14) for the fourth spherical quadrilateral 14 are illustrated in FIGS. 4A and 4B.

A dimple having a centroid that is located along an edge is referred to herein as a shared dimple. All other dimples that do not have a centroid located along said edges are understood to be non-shared dimples. If a majority of a dimple is located within a certain spherical quadrilateral or zone, then that dimple is considered to be located within or belong to the associated spherical quadrilateral or zone.

The zones can be configured to not be rotationally symmetric about an axis extending through a geometric centroid and a respective segment face of the zones. Stated differently, each of the zones can be rotationally asymmetrical on the golf ball surface. In one aspect, a dimple can have a centroid that is coincident with the geometric centroid of the zones. In one aspect, the geometric centroids of the zones can lack a dimple centroid. In one aspect, a dimple can have a centroid that is coincident with the spherical edge between zone A and zone B, and that dimple can be considered a shared dimple. A dimple having a centroid that is coincident with the spherical edge between zone A and zone B is considered to be part of both zone A and zone B. In one aspect, half of the dimple is assigned to zone A and half of the dimple is assigned zone B.

A dimple can have a centroid that is coincident with a spherical inner edge of spherical quadrilateral. Some exemplary dimples having centroids that are coincident with spherical inner edges of spherical quadrilaterals are shown in FIGS. 4A and 4B. A dimple having a centroid that is coincident with a spherical inner edge of a spherical quadrilateral can be considered to be part of the two adjacent spherical quadrilaterals with half of the dimple being assigned to one quadrilateral and half of the dimple being assigned to the second quadrilateral. One exemplary dimple can be the "C" dimples in the FIG. 4A that are split between the first spherical quadrilateral 11 and the second spherical quadrilateral 12. Likewise, another exemplary dimple can be the "F" dimples in FIG. 4B that are split between the third spherical quadrilateral 13 and the fourth spherical quadrilateral 14. In another aspect, the spherical inner edges of the spherical quadrilaterals can be configured to not intersect any dimple centroids. In another aspect, a dimple centroid can be coincident with a vertex of a zone and/or with a vertex of a spherical quadrilateral.

In one aspect, only dimples having a predefined and identical diameter are shared between zones. In another aspect, only dimples having a minimum dimple diameter (i.e., "A" dimples) among the plurality of dimples are shared between zones. In another aspect, dimples of various dimple diameters can be shared between zones.

In one aspect, no dimple centroid is coincident with a geometric centroid of a face of the zones. In another aspect, a dimple centroid can be coincident with a geometric centroid of a face of at least one of the zones.

In one aspect, there are at least three dimples in each zone that are shared by adjacent spherical quadrilaterals. In one aspect, there are exactly three dimples in each zone that are shared by adjacent spherical quadrilaterals. In one aspect, there are at least two dimples in each zone that are shared by adjacent spherical quadrilaterals. In one aspect, there are no greater than five dimples in each zone that are shared by adjacent spherical quadrilaterals.

In one aspect, each zone includes at least one dimple having a maximum dimple diameter among the plurality of dimples. In one aspect, one of the zones lacks any dimples having a maximum dimple diameter among the plurality of dimples. The specific dimple pattern can vary based on the present disclosure as would be understood by one of ordinary skill in the art.

In one aspect, each zone includes at least one non-shared dimple having a minimum dimple diameter among the plurality of dimples. This is illustrated by "A" dimples in FIGS. 4A and 4B being disposed inward relative to the edges of the zones. In one aspect, each spherical quadrilateral includes at least one non-shared dimple having a minimum dimple diameter among the plurality of dimples.

In one aspect, there are no dimple-free great circles on the golf ball. In another aspect, there is at least one dimple-free great circle on the golf ball.

In one aspect, the dimple pattern can consist of at least 100 dimples. In one aspect, the dimple pattern can consist of at least 200 dimples. In another aspect, the dimple pattern can consist of at least 300 dimples. In another aspect, the dimple pattern can consist of at least 400 dimples. In another aspect, the dimple pattern can consist of at least 500 dimples. In another aspect, the dimple pattern can consist of at least 750 dimples. In another aspect, the dimple pattern can consist of at least 900 dimples.

In one aspect, the dimple pattern can consist of no greater than 500 dimples. In one aspect, the dimple pattern can consist of no greater than 400 dimples. In one aspect, the dimple pattern can consist of no greater than 300 dimples. In one aspect, the dimple pattern can consist of no greater than 200 dimples. In one aspect, the dimple pattern can consist of no greater than 100 dimples.

In one aspect, the dimple pattern can consist of exactly 348 dimples. In another aspect, the dimple pattern can consist of exactly 302 dimples. In another aspect, the dimple pattern can consist of exactly 312 dimples. In another aspect, the dimple pattern can consist of exactly 328 dimples. In another aspect, the dimple pattern can consist of exactly 346 dimples. In another aspect, the dimple pattern can consist of exactly 350 dimples. In another aspect, the dimple pattern can consist of exactly 352 dimples. In another aspect, the dimple pattern can consist of exactly 362 dimples. In another aspect, the dimple pattern can consist of exactly 372 dimples. In another aspect, the dimple pattern can consist of exactly 376 dimples. In another aspect, the dimple pattern can consist of exactly 388 dimples. In one aspect, the dimple pattern can consist of 346 dimples-388 dimples.

In one aspect, the first zone includes dimples having at least seven different diameters. In one aspect, the first zone includes dimples having at least nine different diameters. In one aspect, the second zone includes dimples having no greater than five different diameters. In one aspect, the second zone includes dimples having no greater than three different diameters. One of ordinary skill in the art would understand that the zones can have dimples of various dimple diameters.

In one aspect, the dimple pattern can consist of: a first subset of dimples having a diameter of 0.126 inches-0.130 inches (i.e., "A" dimples); a second subset of dimples having a diameter of 0.141 inches-0.145 inches (i.e., "B" dimples); a third subset of dimples having a diameter of 0.151 inches-0.155 inches (i.e., "C" dimples); a fourth subset of dimples having a diameter of 0.161 inches-0.165 inches (i.e., "D" dimples); a fifth subset of dimples having a diameter of 0.166 inches-0.170 inches (i.e., "E" dimples); a sixth subset of dimples having a diameter of 0.176 inches-0.180 inches (i.e., "F" dimples); and a seventh subset of dimples having a diameter of 0.188 inches-0.192 inches (i.e., "G" dimples).

In one aspect, Table 1 defines further parameters of the dimple pattern according to one specific example. One of ordinary skill in the art would understand that the diameters and quantities of dimples can vary.

TABLE 1

| Dimple Diameter Label | Diameter (inches) | Quantity per Hemisphere |
|---|---|---|
| A | 0.128 | 28 |
| B | 0.143 | 8 |
| C | 0.153 | 28 |
| D | 0.163 | 36 |
| E | 0.168 | 40 |

TABLE 1-continued

| Dimple Diameter Label | Diameter (inches) | Quantity per Hemisphere |
|---|---|---|
| F | 0.178 | 22 |
| G | 0.190 | 12 |

In one aspect, the dimple pattern includes at least twice as many dimples having a minimum diameter as dimples having a maximum diameter. In one aspect, the second zone lacks any of the second subset of dimples or the third subset of dimples.

In one aspect, the first spherical quadrilateral lacks any of the sixth subset of dimples.

In one aspect, only the second spherical quadrilateral includes the second subset of dimples.

In one aspect, each of the first, second, third, and fourth spherical quadrilaterals has a dimple with a maximum diameter among the plurality of dimples. In one aspect, the dimples with the maximum diameter can have a centroid that is not coincident with an internal edge or an external edge of a respective one of the first, second, third, or fourth spherical quadrilaterals. In one aspect, each of the first, second, third, and fourth spherical quadrilaterals can have an identical quantity of dimples having a maximum diameter among the plurality of dimples.

In one aspect, the second spherical quadrilateral lacks any of the fifth subset of dimples.

In one aspect, the three first spherical quadrilaterals of the first zone interface with each other at a first common vertex, and three nearest dimples to the first common vertex are non-coincident with internal edges of the three first spherical quadrilaterals of the first zone. In another aspect, the three second spherical quadrilaterals of the second zone interface with each other at a second common vertex, and three nearest dimples to the second common vertex are coincident with internal edges of the three second spherical quadrilaterals of the second zone.

In one aspect, a quantity of the fifth subset of dimples in the dimple pattern is greater than a quantity of the first, second, third, fourth, sixth, or seventh subset of dimples.

In one aspect, a quantity of the second subset of dimples in the dimple pattern is less than a quantity of the first, third, fourth, fifth, sixth, or seventh subset of dimples.

In one aspect, dimples disposed nearest to at least two vertices of the first zone include the first subset of dimples. In another aspect, dimples disposed nearest to three vertices of the second zone includes dimples from the seventh subset of dimples.

The configuration of dimples for the polar axis of the golf ball can be arranged according to a specific methodology or pattern. In one aspect, at least one subset of the dimples (referred to herein as the subset of preferred polar dimples) in the first and third spherical quadrilaterals can correspond to the positions of retractable pins for retractable pin injection molding (RPIM). In another aspect, the subset of preferred polar dimples can correspond to the positions of critical or significant elements or features associated with any one or more of reaction injection-molding (RIM), liquid injection-molding, compression molding, casting, etc. In one specific arrangement, the subset of preferred polar dimples can have centroids that are disposed no more than 30 degrees from the nearest pole. In another aspect, the subset of preferred polar dimples can have centroids that are disposed no more than 20 degrees from the nearest pole. In another aspect, the subset of preferred polar dimples can have centroids that are disposed no more than 10 degrees from the nearest pole.

Figure 5A:
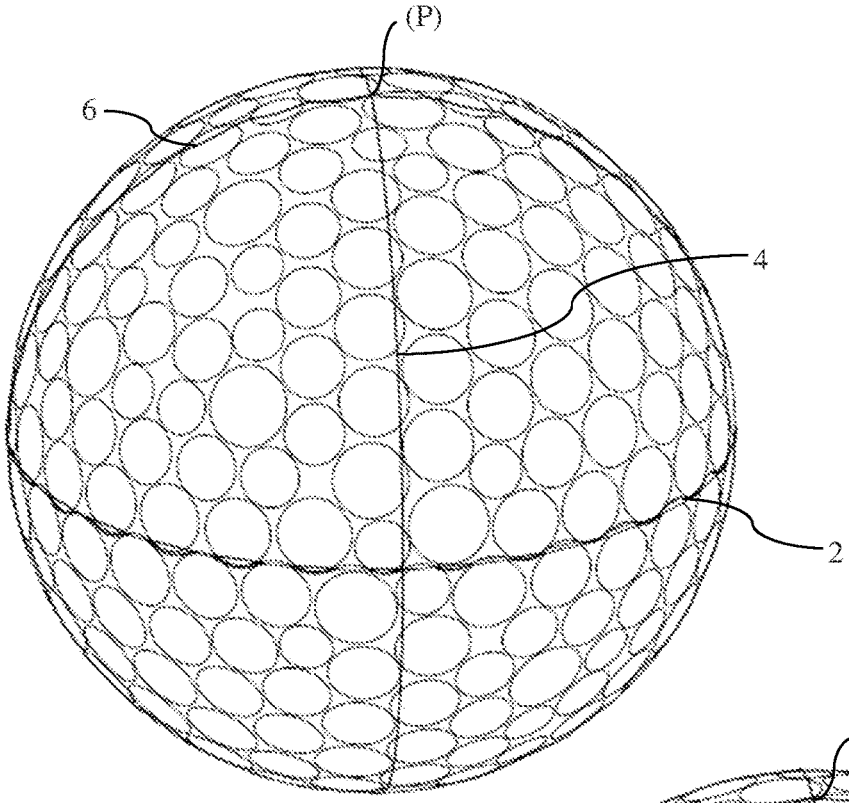
FIG. 5A is a front view of an exemplary golf ball.
Figure 5B:
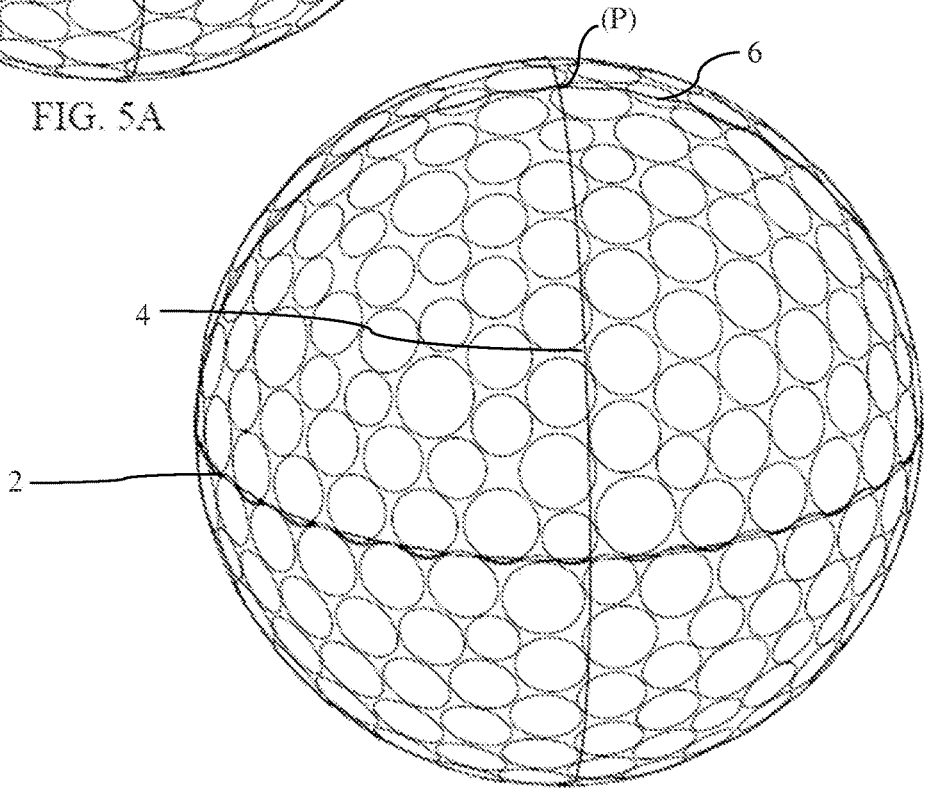
FIG. 5B is a rear view of an exemplary golf ball.
Figure 5C:
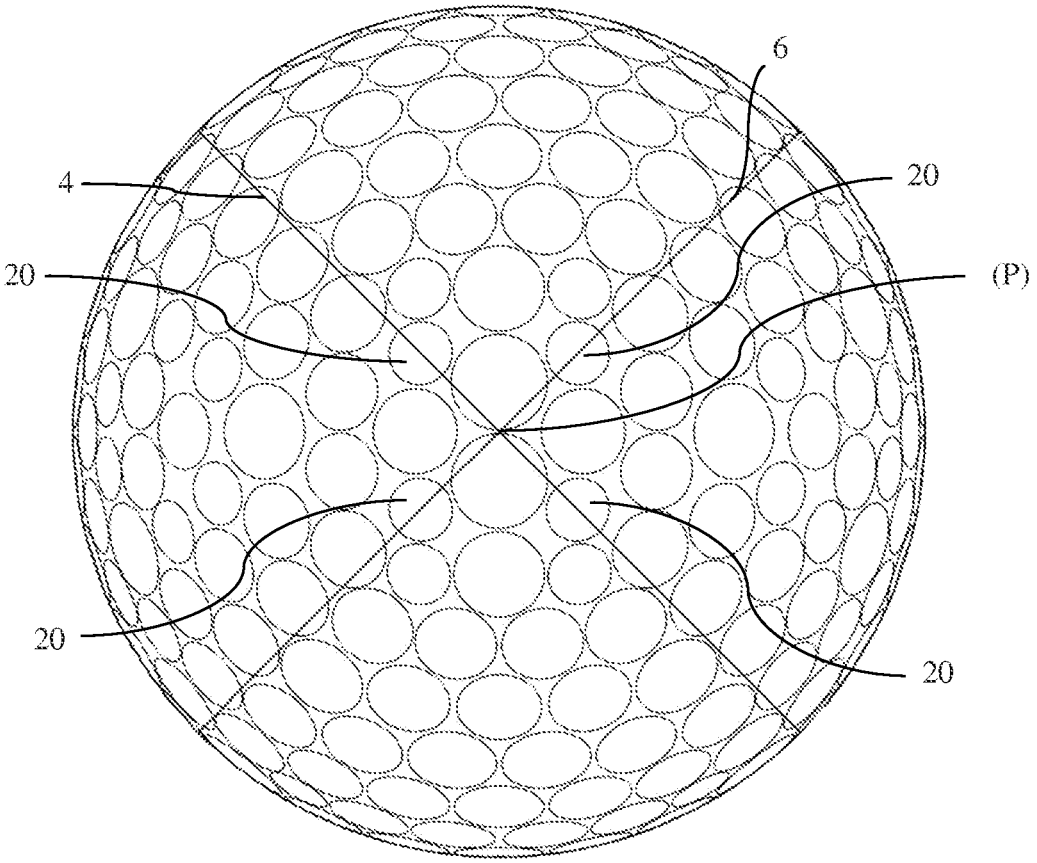
FIG. 5C is a top view (i.e., polar region view) of an exemplary golf ball.

A quantity of the subset of preferred polar dimples can be identical to a quantity of zones in each hemisphere, in one aspect. The quantity of the subset of preferred polar dimples and zones in each hemisphere can vary, as one of ordinary skill in the art would appreciate based on this disclosure. An exemplary subset of preferred polar dimples 20 are illustrated in FIG. 5C, and can include four dimples in one example.

The dimple pattern can include dimples of an identical diameter whose centroids share a common latitudinal degree coordinate but whose longitudinal degree difference or offset is identical to a hemisphere segment degree span. For example, there can be four dimples with an identical diameter that are disposed at the same common latitude and are spaced from each other by 90 degrees longitudinally, and the hemispheres can be divided into four equal zones (which can each be defined by a 90 degree longitudinal span). The dimples having a common diameter and latitudinal degree but differing longitudinal degree may be polar dimples.

In RPIM techniques for golf ball covers, the retractable pins can be configured to move in and out of the cavity vertically, and can be disposed on a bolt circle large enough to provide stability to a centered golf ball sub-assembly that is dropped into place, and also close enough to the pole in order to be retracted as late as possible. Additionally, stationary vent pins can be disposed nearest to the pole to allow for prolonged off-gassing, thereby improving knit in the injected thermoplastic material. In one aspect, the present disclosure provides a pole configuration that addresses various challenges of RPIM while simultaneously promoting a high level of geometric symmetry. Accordingly, in one aspect, the present disclosure provides benefits with respect to manufacturing techniques while allowing for various dimple pattern designs for varying flight orientations and aerodynamic packages.

In one aspect, a golf ball having an outer surface comprising a plurality of dimples disposed thereon that define a dimple pattern is provided herein. The golf ball can be segmented via an equatorial plane, and a first plane and a second plane each being orthogonal to the equatorial plane and to each other, such that a first subset of four zones define a first hemisphere of the golf ball and a second subset of four zones define a second hemisphere of the golf ball. The first and second subset of four zones can be comprised of first zones and second zones, such that the first and second hemispheres each consist of two first zones and two second zones.

The first zone can consist of three spherical quadrilaterals including at least one first spherical quadrilateral and at least one second spherical quadrilateral, and the second zone can consist of three spherical quadrilaterals including at least one third spherical quadrilateral and at least one fourth spherical quadrilateral. In one aspect, the first, second, third, and fourth spherical quadrilaterals each have: (i) distinct dimple configurations, and (ii) dimple configurations having mirror symmetry about a respective symmetry plane.

In one aspect, the three spherical quadrilaterals of the first zone include a single first spherical quadrilateral and two second spherical quadrilaterals. In one aspect, the three spherical quadrilaterals of the second zone include a single third spherical quadrilateral and two fourth spherical quadrilaterals. The at least one second spherical quadrilateral and the at least one fourth spherical quadrilateral can be disposed along the equatorial plane. The at least one first spherical quadrilateral and the at least one third spherical quadrilateral can each be disposed adjacent to a polar axis of the golf ball.

The first, second, third, and fourth spherical quadrilaterals can each have an identical size relative to each other. The first and second zones can each have distinct dimple patterns from each other. The first zones and the second zones can be mirror symmetrical about a respective plane extending through a polar axis of the golf ball.

The dimple pattern can have at most second order rotational symmetry about any axis of the golf ball. In one specific aspect, the dimple pattern can have at most second order rotational symmetry about an axis defined by any two planes of the golf ball selected from: the equatorial plane, the first plane, and the second plane.

The first, second, third, and fourth spherical quadrilaterals can each include two external edges that are coplanar with at least one edge of the first or second zones, and the first, second, third, and fourth spherical quadrilaterals can each include two internal edges that are noncoplanar with edges of the first and second zones. The internal edges of the first, second, third, and fourth spherical quadrilaterals can each be shorter than the external edges of the first, second, third, and fourth spherical quadrilaterals.

In one aspect, the respective symmetry planes of the first, second, third, and fourth spherical quadrilaterals can each extend through a centroid of a respective one of the first and second zones.

The first and second zones can each be rotationally asymmetric about an axis passing through a golf ball centroid and a respective geometric face of the first zone and the second zone.

The first, second, third, and fourth spherical quadrilaterals can each be irregularly shaped polygons.

The dimple pattern can include 300-400 dimples, in one aspect. The dimple pattern can include 100-700 dimples, or 250-550 dimples, or at least 600 dimples, or less than 225 dimples in other aspects. The golf ball can lack any dimple-free great circles, in one aspect.

The plurality of dimples can include dimples of at least two, three, four, five, six, seven, eight, nine, ten, or eleven or more different dimple diameters, in one aspect.

In one aspect, exactly two of the three spherical quadrilaterals of the first zones and exactly two of the three spherical quadrilaterals of the second zones can share a common vertex at a polar axis of the golf ball.

In one aspect, a golf ball is disclosed that has an outer surface comprising a plurality of dimples disposed thereon that define a dimple pattern. The golf ball can be segmented into a first hemisphere and a second hemisphere, each of the first and second hemispheres being defined by a plurality of zones, and each zone being segmented into a plurality of spherical quadrilaterals each having a distinct dimple configuration. The dimple pattern can have at most second order rotational symmetry about any axis of the golf ball, in one aspect.

The first and second hemispheres can each include a subset of preferred polar dimples having an identical dimple diameter and a respective centroid positioned longitudinally 90 degrees apart from each other and at a common latitude, wherein the common latitude is defined at a polar latitude angle (θ) from a nearest respective pole of the first and second hemispheres, and the polar latitude angle (θ) is no greater than 30 degrees. In one aspect, the polar latitude angle (θ) is no greater than 25 degrees. In another aspect, wherein the polar latitude angle (θ) is no greater than 20 degrees. The polar latitude angle (θ) is no greater than 10 degrees in another aspect. The polar latitude angle (θ) is no greater than 5 degrees in another aspect. The polar latitude angle (θ) can be 5-20 degrees in another aspect. The polar latitude angle (θ) can be 10-15 degrees in another aspect. FIGS. 5A-5C show particular aspects of the overall golf ball dimple pattern and the polar dimples.

The centroids of each of the dimples of the subset of preferred polar dimples can be coincident with a spherical edge defined between adjacent zones. In another aspect, the centroids of each of the subset of preferred polar dimples are not coincident with a spherical edge defined between adjacent zones. The centroids of each of the subset of preferred polar dimples can be coincident with a mirror symmetry plane of at least one of the spherical quadrilaterals, in another aspect.

In one aspect, the dimple pattern can include a dimple having a centroid that is coincident with a polar axis of the golf ball, which can be referred to as a pole dimple. In another aspect, the dimple pattern can lack any dimple having a centroid that is coincident with a polar axis of the golf ball.

The diameter of the dimples of the subset of preferred polar dimples can have a minimum dimple diameter among the plurality of dimples. In another aspect, the diameter of the subset of preferred polar dimples does not have a minimum dimple diameter among the plurality of dimples.

At least one additional polar dimple can be disposed closer to the poles of the first and second hemispheres than the subset of preferred polar dimples. In one aspect, the at least one additional polar dimple can have a larger dimple diameter than the dimple diameter of the dimples of the subset of preferred polar dimples.

In another aspect, a golf ball is disclosed that has an outer surface comprising a plurality of dimples disposed thereon that define a dimple pattern, the golf ball being segmented into a first hemisphere and a second hemisphere, each of the first and second hemispheres being defined by a plurality of zones of a first quantity, and each zone being segmented into a plurality of spherical quadrilaterals each having a distinct dimple configuration, the dimple pattern having at most second order rotational symmetry about any axis of the golf ball. The first and second hemispheres can each include a subset of preferred polar dimples of a second quantity. The subset of preferred polar dimples can each have an identical dimple diameter and a respective centroid positioned longitudinally equidistant apart from each other and at a common latitude at a polar latitude angle (θ) from a nearest respective pole of the first and second hemispheres. In one aspect, the polar latitude angle (θ) is no greater than 30 degrees. In another aspect, the polar latitude angle (θ) is no greater than 25 degrees. In another aspect, the polar latitude angle (θ) is no greater than 20 degrees. In another aspect, the polar latitude angle (θ) is no greater than 15 degrees. In another aspect, the polar latitude angle (θ) is no greater than 10 degrees. In another aspect, the polar latitude angle (θ) is no greater than 5 degrees.

In one aspect, the first quantity (i.e., the quantity of zones within each hemisphere) and the second quantity (i.e., the quantity of dimples among the subset of preferred polar dimples in each hemisphere) are identical. In another aspect, the first and second quantities are different. In one aspect, the first quantity and the second quantity are each at least three. In one aspect, the first quantity and the second quantity are each at least four. In one aspect, the first quantity and the second quantity are each exactly four.

In one aspect, aspects of the present configuration provide an improved ability for forming the cover on the golf ball, particularly during various formation techniques, such as reaction injection-molding (RIM), retractable pin injection-molding (RPIM), liquid injection-molding, compression molding, casting, as well as other formation techniques.

The terms "about" and "approximately" shall generally mean an acceptable degree of error or variation for the quantity measured given the nature or precision of the measurements. Numerical quantities given in this description are approximate unless stated otherwise, meaning that the term "about" or "approximately" can be inferred when not expressly stated.

The terms "first," "second," and the like are used to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the disclosure.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

What is claimed is:

1. A golf ball having an outer surface comprising a plurality of dimples disposed thereon that define a dimple pattern, the golf ball being segmented into a first hemisphere and a second hemisphere, each of the first and second hemispheres being defined by a plurality of zones, and each zone being segmented into a plurality of spherical quadrilaterals each having a distinct dimple configuration, wherein the dimple pattern has at most second order rotational symmetry about any axis of the golf ball, and wherein the first and second hemispheres each include a subset of preferred polar dimples having:

(i) an identical dimple diameter, (ii) a respective centroid positioned longitudinally 90 degrees apart from each other, and (iii) a respective centroid positioned at a common latitude, wherein the common latitude is defined at a polar latitude angle (θ) from a nearest respective pole of the first and second hemispheres, and the polar latitude angle (θ) is no greater than 30 degrees, wherein the plurality of zones includes a first zone consisting of three spherical quadrilaterals including at least one first spherical quadrilateral and at least one second spherical quadrilateral, and a second zone consisting of three spherical quadrilaterals including at least one third spherical quadrilateral and at least one fourth spherical quadrilateral, and the first, second, third, and fourth spherical quadrilaterals each have:

(i) distinct dimple configurations, and (ii) dimple configurations having mirror symmetry about a respective symmetry plane, and (iii) an identical size relative to each other.

2. The golf ball according to claim 1, wherein the polar latitude angle (θ) is no greater than 25 degrees.

3. The golf ball according to claim 1, wherein the polar latitude angle (θ) is no greater than 20 degrees.

4. The golf ball according to claim 1, wherein the polar latitude angle (θ) is no greater than 10 degrees.

5. The golf ball according to claim 1, wherein the centroids of each of the dimples of the subset of preferred polar dimples is coincident with a spherical edge defined between adjacent zones.

6. The golf ball according to claim 1, further comprising a polar dimple having a centroid that is coincident with a polar axis of the golf ball.

7. The golf ball according to claim 1, wherein the dimple pattern lacks any dimple having a centroid that is coincident with a polar axis of the golf ball.

8. The golf ball according to claim 1, wherein the diameter of the dimples of the subset of preferred polar dimples has a minimum dimple diameter among the plurality of dimples.

9. The golf ball according to claim 1, wherein at least one additional polar dimple is disposed closer to the poles of the first and second hemispheres than the dimples of the subset of preferred polar dimples, and the at least one additional polar dimple does not have a minimum dimple diameter among the plurality of dimples.

10. The golf ball according to claim 9, wherein the at least one additional polar dimple has a larger dimple diameter than the diameter of the dimples of the subset of preferred polar dimples.

11. A golf ball having an outer surface comprising a plurality of dimples disposed thereon that define a dimple pattern, the golf ball being segmented into a first hemisphere and a second hemisphere, each of the first and second hemispheres being defined by a plurality of zones of a first quantity, and each zone being segmented into a plurality of spherical quadrilaterals each having a distinct dimple configuration, the dimple pattern having at most second order rotational symmetry about any axis of the golf ball, and wherein the first and second hemispheres each include a subset of preferred polar dimples of a second quantity, the subset of preferred polar dimples each having an identical dimple diameter and a respective centroid positioned longitudinally equidistant apart from each other and at a common latitude at a polar latitude angle (θ) from a nearest respective pole of the first and second hemispheres, wherein the first and second quantities are identical, wherein the plurality of zones includes a first zone consisting of three spherical quadrilaterals including at least one first spherical quadrilateral and at least one second spherical quadrilateral, and a second zone consisting of three spherical quadrilaterals including at least one third spherical quadrilateral and at least one fourth spherical quadrilateral, and the first, second, third, and fourth spherical quadrilaterals each have:

(i) distinct dimple configurations, and (ii) dimple configurations having mirror symmetry about a respective symmetry plane, and (iii) an identical size relative to each other.

12. The golf ball according to claim 11, wherein the polar latitude angle (θ) is no greater than 30 degrees.

13. The golf ball according to claim 11, wherein the first quantity and the second quantity are at least three.

14. The golf ball according to claim 11, wherein the first quantity and the second quantity equal four.

* * * * *